United States Patent [19]

Bercovici

[11] Patent Number: 4,501,315

[45] Date of Patent: Feb. 26, 1985

[54] METHOD OF CONTROLLING AND REGULATING OPERATIONAL PARAMETERS OF A MACHINE FOR CONTINUOUSLY CASTING BANDS BETWEEN CYLINDERS, ALLOWING ADHESION TO BE AVOIDED

[75] Inventor: Serge Bercovici, Grenoble, France

[73] Assignee: Cegedur Societe de Transformation de l'Aluminium Pechiney, Paris, France

[21] Appl. No.: 339,846

[22] Filed: Jan. 18, 1982

[30] Foreign Application Priority Data

Jan. 19, 1981 [FR] France ..... 81 01185

[51] Int. Cl.[3] ..... B22D 11/16

[52] U.S. Cl. ..... 164/454; 164/413

[58] Field of Search ..... 164/413, 452, 454; 72/8, 19

[56] References Cited

U.S. PATENT DOCUMENTS 2,824,346 2/1958 Osborn ..... 164/452
3,478,808 11/1969 Adams ..... 164/454
4,162,699 7/1979 Mairy ..... 164/454

FOREIGN PATENT DOCUMENTS 8019162 7/1980 France .

*Primary Examiner*—Kuang Y. Lin
*Assistant Examiner*—Richard K. Seidel
*Attorney, Agent, or Firm*—McDougall, Hersh & Scott

[57] ABSTRACT

The present invention relates to a method of controlling and regulating operational parameters of a machine for continuously casting bands between cylinders, allowing adhesion to be avoided. This method comprises considering as parameters the torque exerted on one or other of the cylinders for moving the band on and comprises permanently comparing the frequency of the variations in the torque measurement with a reference frequency. When the variation frequency is greater than the reference frequency, the casting speed of the machine is reduced and/or the lubricant flow rate is increased until the variation frequency is again lower than the reference frequency. The speed of the casting machine is then increased as long as the variation frequency remains below the reference frequency.

15 Claims, 1 Drawing Figure

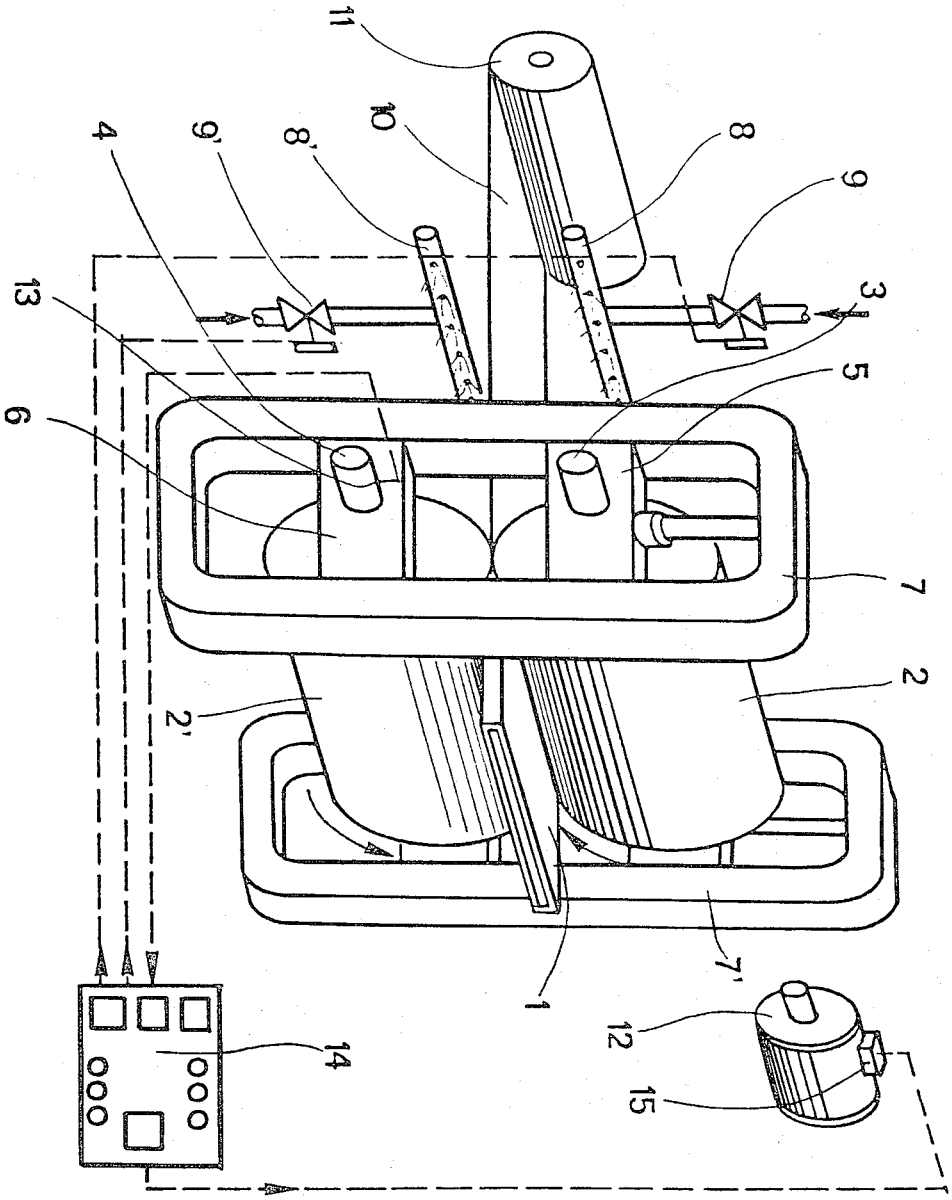
11
10
8
9
3
5
7
2
7'
1
12
15
14
4
9'
8'
13
6
2'

METHOD OF CONTROLLING AND REGULATING OPERATIONAL PARAMETERS OF A MACHINE FOR CONTINUOUSLY CASTING BANDS BETWEEN CYLINDERS, ALLOWING ADHESION TO BE AVOIDED

The object of the present invention is to provide a method of controlling and regulating operational parameters of a machine for casting bands between cylinders, allowing adhesion to be avoided and maximum productivity to be obtained.

The man skilled in the art is acquainted with mobile mould casting machines of the cylinder type which are used for directly producing a continuous band from a molten metallic mass. The width of the band may amount to several meters and the thickness thereof approaches a centimeter.

In principle, these machines comprise the following:

on the one hand, a device supplying liquid metal, successively comprising in the outflow direction of the metal:

- a furnace for maintaining the metal in a liquid condition,
- a circulation chute equipped with a system controlling the level and flow rate of the metal, and
- a nozzle for distributing the metal having an opening of rectangular cross section at its outlet end;

on the other hand, a cooling and rolling device comprising two cylinders, the axles of which are parallel and are more or less at a distance from each other depending on the required band thickness. At each of their ends, the cylinders are provided with axial, cylindrical extensions or axles which are engaged by means of journal bearings in openings made in support cross-pieces or bearings equipped with a tightening system and being integral with two vertical columns which form the frame of the machine. Inside, the cylinders are provided with a pipe system, along which a cooling fluid circulates and they are connected by means of extension pieces with a motor which drives them with an opposite rotational movement. The external surface of these cylinders is sprayed regularly with lubricant by a suitable spray system.

These two devices are positioned in relation to each other such that the outlet section of the nozzle is parallel to the axles of the cylinders and is located at a certain distance from the plane passing through these axles, which is termed the "outlet plane".

During the operation of the machine, the metal distributed by the nozzle fills the empty space between the cylinders along an arc of a circle included between the outlet section plane of the nozzle and the outlet plane of the cylinders.

By the action of the cylinders, the metal cools and starts to solidify in a location which is termed a marsh due to the presence of a more of less viscous crystal-liquid mixture, positioned at a distance from the outlet section plane of the nozzle, generally termed "marsh depth". The metal then completely solidifies and is carried along towards the outlet plane of the cylinders in an increasingly restricted space, where it undergoes a rolling force which progressively brings it to the required thickness at the time when it escapes through the space between the cylinders in the form of a band which is then taken up by a winding machine.

This band is later subjected to different machanical and/or thermal treatments which result in products, such as for example, thin sheets, the mechanical properties of which: resistance, yield strength, elongation and hardness etc., will partly depend on the quality of the band which has issued from the casting machine.

Thus, it is important to try to maintain a good quality from the start to the finish of the band casting. In order to achieve this objective, it is necessary to operate the machine under conditions which are most favorable for obtaining a result of this type, even when the machine is operated at its maximum speed.

Good quality assumes the absence of defects, such as cracks and fissures or metal running out at the outlet of the cylinders, and the principal French patent application No. 80 19162 discloses a control and regulation method allowing this need to be met and in which the following are used as operational parameters: the rolling forces, the total torque necessary for moving the band on and the temperature at the outlet of the band. However, a method of this type does not take into account adhesion phenomena which may arise between the cylinders and the cast product and may persist beyond the outlet plane of the cylinders, causing the occurrence of fairly considerable defects on the band and occasionally necessitating the band to be rejected.

The causes of this adhesion are simultaneously associated with the casting speed and with the flow rate of the lubricant sprayed onto the cylinders. In fact, it has been established that the adhesion tendency becomes more critical above certain speeds. In order to guard against this tendency, it is of course possible to increase the flow rate of the lubricant, but the skilled man knows that too much lubrication risks impairing the thermal exchange between the cast metal and the surface of the cylinders and risks resulting in the formation of metal run-outs. Consequently, it is then necessary to reduce the speed of the machine and to thus cut the productivity thereof. Hence the necessity of finding optimum conditions of lubricant flow rate and casting speed which allow the machine to operate at its maximum while avoiding adhesion. The idea could be conceived of fixing these conditions once and for all, but they are not stable in the time, because they depend on numerous variable factors, such as homogeneity, temperature and level of the liquid metal and temperature and condition of the cylinder surfaces, factors for which complete and continuous regulation and control is difficult and, for some of them, impossible.

Moreover, casting machines are usually operated at speeds which are clearly below their capability in order to avoid adhesion, whatever the possible variations in the operation factors.

For this reason, the Applicant has studied and perfected a method of controlling and regulating the operational parameters of the casting machine, allowing adhesion to be avoided while maintaining maximum productivity.

This method in which the torque exerted on one or other of the cylinders to move the band on is used as a parameter, and not the complete torque, is characterised in that the frequency of the variations of the torque measurement is permanently compared with a reference frequency. When the variation frequency is greater than the reference frequency, the casting speed of the machine is reduced and/or the lubricant flow rate is increased until the variation frequency is again lower than the reference frequency and remains in this condition during a given time, then the casting speed is increased as long as the variation frequency remains below the reference frequency.

Thus, the method according to the present invention initially comprises only considering the torque exerted on one or other of the cylinders for moving the band on as an operational parameter. The use of this parameter arises from the fact that when the band adheres to one of the cylinders, almost all of the torque is supported by the opposite cylinder without substantially affecting the complete torque which, when there is no adhesion, is almost equally distributed between the two cylinders. Thus, it is sufficient to consider one or other of these torques to detect the sudden variation corresponding to the occurrence of adhesion. However, it may appear under these conditions that the present method is limited to a rapid detection of the phenomenum and to an intervention with the aim of suppressing the phenomenum, which would not prevent the occurrence of a defect on the band and, in spite of everything, would result in partial rejection of the band.

In fact, the present method aims to provide adhesion and to also provide reaction means even before the defect has become apparent.

This has been allowed due to the Applicant's observations showing that, before the formation of an adhesion prejudicial to the condition of the band, a micro-adhesion is initially produced, being restricted to a very small area on both sides of a generatrix of one of the cylinders and not interfering with the quality of the band, then an immediate detachment followed by new micro-adhesion, and thus in succession up to the generalised adhesion generally arising after the cylinder has rotated once or several times. Thus, it should be possible to perceive such micro-adhesions to forestall the generalisation thereof. Here again, the Applicant has shown that during normal operation, the value of the torque measured on one of the cylinders fluctuated during a long period of the order of a few ten seconds, whereas, if micro-adhesion appear, this period substantially decreases resulting in values of less than one second.

Thus, for perceiving micro-adhesion, it is sufficient to detect this decrease in the fluctuation period, while comparing it with a reference period of the order of a second, or since the period is the reciprocal of the frequency, to take the latter as a measuring element and to compare it with a frequency of the order of a Hertz.

In practical terms, this has been effected by filtering in frequency, using capacitors, the electrical signal given by an extensometry gauge positioned, for example, on the extension piece of a cylinder or on one of the axles of the machine. However, it is also possible to use the indications from a frequency meter or any other suitable means. During normal operation, the filtered signal is almost constant and is zero when the variation frequency is smaller than Hertz. On the other hand, as soon as micro-adhesions appear, the filtered signal substantially deviates from the value 0 and oscillates with a certain frequency, whereas a variation in the intensity of the driving motor of the cylinders, and thus of the total torque cannot be measured.

Being thus forewarned of the impending formation of the defect, it should be possible to prevent the occurrence thereof. For this purpose, the casting speed is reduced and/or the lubricant flow rate is increased.

The speed is reduced, for example, by acting on the continuous supply voltage of the motor for driving the cylinders. The lubricant flow rate is modified, for example, by a different adjustment of the inlet valves. This intervention is not immediately produced after the detection of a signal indicating that the torque variation frequency is greater than the reference frequency, but after this signal has remained for about 5 seconds, so as to rule out the fleeting increases which may be produced and are due to transient variations of some operational parameters without being related to the adhesion phenomenum.

After having thus modified the operational conditions of the machine, either the signs indicating adhesion persist, in which case the speed is again reduced and/or the lubricant flow rate is again increased or, on the contrary, the indicating signs disappear and it is then possible after a given stability time of the order of from one to a few minutes, to again increase the speed as long as the variation frequency remains below the reference frequency.

The speed of the machine may be reduced or increased progressively or in stages of determined duration.

Thus, the speed may be reduced during periods of time shorter than 5 minutes by a quantity below 15% of its value at the instant immediately before the reduction.

Likewise, the speed may be increased during periods of time shorter than 5 minutes by a quantity less than 10% of its value at the instant immediately before the increase.

The flow rate of the lubricant may be increased by from 5 to 15% of its value when the micro-adhesions appeared.

The following different functions: analysis of the signals emitted by the extensometry gauge and the use thereof with respect to the speed of the machine or the lubrication conditions are performed by a calculator of the computer, minicomputer, microprocessor type or the conventional programmable automatic type.

BRIEF DESCRIPTION OF THE DRAWING

The FIGURE is a perspective view of the apparatus for performing the process of the invention.

DETAILED DESCRIPTION OF THE INVENTION

A better comprehension of the present invention will be gained from the single FIGURE illustrating a type of machine on which may be seen a supply nozzle (1). The liquid metal is admitted through the nozzle (1) between the two cylinders (2 and 2'), the axles (3 and 4) of which are supported by the bearings (5 and 6) which are integral with the column (7). The surface of the two cylinders is lubricated by rows of distributors (8 and 8') which are supplied with lubricant by the valves (9 and 9'). After cooling and rolling, the metal exits from the machine in the form of a band (10) which is wound at (11). The cylinders are driven with an opposite rotational movement by a motor (12).

The torque measurement on one of the cylinders is detected by the extensometry gauge (13). This measurement is transmitted to the calculator (14) which, in (15) controls the speed of the motor by modifying the voltage of the supply current and at (16 and 16'), controls the entry of the lubricant into the rows by the valves (9) and (9').

The use of the present invention is illustrated by the following example:

An alloy 1235, the composition of which is described in "Standard for Aluminum Mill Products", published by ALUMINUM ASSOCIATION is cast in the form of a band, being 8 mm thick, at a speed of 1.30 m/mn and with a lubricant flow rate of 10 l/hour by means of a SCAL JUMBO 3C type machine, equipped with a PERKIN ELMER 1620 minicomputer. Since the speed of the machine and the valves for admitting the lubricant are not controlled by the computer, the torque exerted on the lower cylinder is permanently measured by means of an extensometry gauge adfixed to the axle and the signal is sent on an electronic device allowing the torque variations to be directly detected and also allowing this signal to be electronically filtered so that only those signals are retained, the frequency of which is greater than one Hertz. Registration of the signals before filtration shows the variations on both sides of an average value of the torque of a period of the order of 30 seconds, while the indicator of the filtered signal remains at zero.

After casting for ten minutes, an increase in the variations of the torque measurement is noted, the frequency of which approaches 3 Hertz and the filtered signal indicator deviates from zero. This phenomenum lasts for 2 seconds, then the indicator returns to zero indicating that the machine is again operating under normal conditions. After a few minutes, the same phenomenum reoccurs lasting for 10 seconds and stops again. After four perturbations of this kind, the torque measurement suddenly increases and a generalised adhesion is produced.

After discarding the band, the same operational conditions as before are regained, i.e., a casting speed of 1.3 m/mn and a lubricant flow rate of 10 l/hour and the speed of the machine and the valves for admitting the lubricant are brought under the control of the filtered signal indications using the minicomputer according to the present invention. After an operating time of 15 minutes, a variation frequency of the torque measurement approaching 3 Hertz is detected. The lubricant flow rate is then automatically increased to 11 l/hour and the casting speed is reduced by 0.05 m/mn. After a few seconds, the variation frequency is normal again and the filtered signal is zero. After an operating time of 5 minutes under these conditions, the speed is progressively increased again up to 1.4 m/mn and casting is continued at this speed, without the occurrence of new microadhesions being established, even after a casting time of several hours.

The method according to the present invention is used for the continuous casting of metals between cylinders in all cases where it is desirable to prevent the band from adhering to the cylinders and to keep the operation of the machine under maximum productivity conditions.

I claim:

1. A method of controlling and regulating operational parameters of a machine for continuous casting bands between cylinders to avoid adhesion by the detection of microadhesion, said method comprising measuring the frequency of variation of the torque exerted by a band on one of the cylinders, comparing the frequency of the torque variations corresponding to each cylinder measured with a reference frequency, and, when the measured frequency is greater than the reference frequency, doing at least one of (a) reducing the casting speed of the machine, and (b) increasing the lubricant flow rate, until the measured frequency is lower than the reference frequency followed by increasing the casting speed.

2. A method as defined in claim 1 wherein the reference frequency comprises at least one Hertz.

3. A method acccording to claim 1, characterised in that the speed is reduced and/or the lubricant flow rate is increased only when the measured frequency is greater than the reference frequency for 5 seconds.

4. A method according to claim 1, characterised in that the casting speed is increased when the measured frequency has remained below the reference frequency for at least one minute.

5. A method according to claim 1, characterised in that the casting speed is reduced in successive stages.

6. A method according to claim 5, characterised in that the casting speed is reduced in each stage by a quantity below 15% of the value of the speed at the immediately lower instant.

7. A method according to claim 5, characterised in that each stage of reducing the speed lasts for less than 5 minutes.

8. A method according to claim 1, characterised in that the speed is increased in successive stages.

9. A method according to claim 1, characterised in that the casting speed is increased in each stage by a quantity below 10% of its value at the instant immediately before the increase.

10. A method according to claim 5, characterised in that each stage for increasing the speed lasts for less than 5 minutes.

11. A method according to claim 1, characterised in that the average flow rate of the lubricant is increased by from 5 to 15% of its initial value.

12. A method of controlling and regulating operational parameters of a machine for continuously casting a band between cylinders to avoid adhesion of said band to a cylinder, said method comprising:

(a) detecting micro-adhesion by measuring the frequency of variation of torque exerted by a band on an individual cylinder;

(b) comparing said measured frequency with a reference frequency; and (c) modifying operational parameters by doing at least one of (i) reducing the casting speed of the machine and (ii) increasing the lubricant flow rate, when said measured frequency exceeds said reference frequency and continuing such modification until said measured frequency is lower than said reference frequency, this operation followed by increasing the casting speed.

13. A method as defined in claim 12 wherein said reference frequency comprises at least one Hertz.

14. A method as defined in claim 13 wherein said measured frequency exceeds said reference frequency for at least five second before doing at least one of (i) reducing casting speed and (ii) increasing lubricant flow rate.

15. A method as defined in claim 12 wherein said parameters are modified before any adhesion-related measurable variation occurs in intensity of cylinder driving motor total torque.

* * * * *